US012195868B2

(12) United States Patent
Ueno et al.

(10) Patent No.: US 12,195,868 B2
(45) **Date of Patent: *Jan. 14, 2025**

(54) SURFACE-TREATED STEEL SHEET AND METHOD OF PRODUCING THE SAME

(71) Applicant: JFE STEEL CORPORATION, Tokyo (JP)

(72) Inventors: Takashi Ueno, Tokyo (JP); Yoichiro Yamanaka, Tokyo (JP); Yoshitsugu Suzuki, Tokyo (JP); Masanari Tomozawa, Tokyo (JP); Haruo Nakamichi, Tokyo (JP); Takashi Kawano, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/256,968

(22) PCT Filed: Nov. 29, 2021

(86) PCT No.: PCT/JP2021/043710
§ 371 (c)(1),
(2) Date: Jun. 12, 2023

(87) PCT Pub. No.: WO2022/138005
PCT Pub. Date: Jun. 30, 2022

(65) Prior Publication Data

US 2024/0035182 A1 Feb. 1, 2024

(30) Foreign Application Priority Data

Dec. 21, 2020 (JP) ..... 2020-211808

(51) Int. Cl.

| | |
|---|---|
| ***C25D 3/06*** | (2006.01) |
| ***C25D 3/10*** | (2006.01) |
| ***C25D 5/36*** | (2006.01) |
| ***C25D 11/38*** | (2006.01) |

(52) U.S. Cl.
CPC ..... *C25D 3/06* (2013.01); *C25D 3/10* (2013.01); *C25D 5/36* (2013.01); *C25D 11/38* (2013.01)

(58) Field of Classification Search
None
See application file for complete search history.

(56) References Cited

U.S. PATENT DOCUMENTS

| | | | | |
|---|---|---|---|---|
| 4,687,713 | A * | 8/1987 | Ogata | C25D 11/38 205/171 |
| 6,280,852 | B1 * | 8/2001 | Shimizu | B32B 15/08 427/407.1 |
| 2014/0227529 | A1 * | 8/2014 | Yamanaka | C08J 7/043 428/416 |
| 2015/0064494 | A1 | 3/2015 | Wijenberg et al. | |
| 2015/0337448 | A1 | 11/2015 | Wijenberg et al. | |
| 2018/0355496 | A1 * | 12/2018 | Nakagawa | C25D 5/605 |
| 2020/0190679 | A1 | 6/2020 | Marmann et al. | |

FOREIGN PATENT DOCUMENTS

| | | | | | |
|---|---|---|---|---|---|
| GB | 2046304 | A | | 11/1980 | |
| JP | S55134197 | A | | 10/1980 | |
| JP | S5735699 | A | | 2/1982 | |
| JP | S57152497 | A | | 9/1982 | |
| JP | S58110695 | A | | 7/1983 | |
| JP | 11029897 | A | * | 2/1999 | C23C 10/60 |
| JP | 2002348698 | A | | 12/2002 | |
| JP | 2015520794 | A | | 7/2015 | |
| JP | 2016505708 | A | | 2/2016 | |
| JP | 2020109205 | A | | 7/2020 | |
| JP | 2020117748 | A | | 8/2020 | |
| JP | 2020200533 | A | | 12/2020 | |
| WO | 2012114737 | A1 | | 8/2012 | |
| WO | 2015177315 | A1 | | 11/2015 | |

OTHER PUBLICATIONS

Alpha-Measure, "Specifications of Deionized Water", accessed Jul. 2, 2024, https://alpha-measure.com/deionized-water-conductivity/ (Year: 2024).*

Feb. 15, 2022, International Search Report issued in the International Patent Application No. PCT/JP2021/043710.

Jan. 5, 2024, the Extended European Search Report issued by the European Patent Office in the corresponding European Patent Application No. 21910157.3.

Yolanda Hedberg et al., Correlation between surface physicochemical properties and the release of iron from stainless steel AISI 304 in biological media, Colloids and Surfaces B: Biointerfaces, 2014, pp. 216-222, vol. 122.

Jun. 24, 2024, Office Action issued by the IP Australia in the corresponding Australian Patent Application No. 2021406790.

* cited by examiner

*Primary Examiner* — Seth Dumbris

(74) *Attorney, Agent, or Firm* — KENJA IP LAW PC

(57) ABSTRACT

It is provided a surface-treated steel sheet that can be produced without using hexavalent chromium and has excellent film wet adhesion and coating secondary adhesion as well as high film corrosion resistance and coating corrosion resistance. It is a surface-treated steel sheet having: a steel sheet; a metallic Cr layer disposed on at least one surface of the steel sheet; and a Cr oxide layer disposed on the metallic Cr layer, and the surface-treated steel sheet has a water contact angle of 50° or less and a total atomic ratio of K, Na, Mg, and Ca adsorbed on the surface to Cr of 5% or less.

9 Claims, No Drawings

SURFACE-TREATED STEEL SHEET AND METHOD OF PRODUCING THE SAME

TECHNICAL FIELD

This disclosure relates to a surface-treated steel sheet, and in particular, to a surface-treated steel sheet with excellent corrosion resistance when laminated with a resin film and when coated, as well as excellent adhesion to the resin film and the coating layer in a wet environment. The surface-treated steel sheet of this disclosure can be suitably used for a container such as a can. This disclosure also relates to a method of producing the surface-treated steel sheet.

BACKGROUND

A Sn coated steel sheet (tinplate) has been used for 200 years or more as a material for various metal cans, including beverage cans, food cans, pails, and 18-liter cans, because of its excellent corrosion resistance, weldability, and workability, and its ease of production.

However, Sn is an expensive material. Thus, a tin-free steel sheet (TFS), a surface-treated steel sheet without Sn, was developed. The tin-free steel sheet is a surface-treated steel sheet with a metallic Cr layer and a Cr oxide layer formed on the surface of the steel sheet, and is usually produced by electrolytic treatment of a steel sheet in an electrolyte containing hexavalent Cr (PTLs 1 to 3). The tin-free steel sheet is now very commonly used as a steel sheet for container instead of tinplate, because of its excellent corrosion resistance and coating adhesion property.

On the other hand, in recent years, increasing environmental awareness has led to a worldwide trend toward regulating the use of hexavalent Cr. Therefore, there is a need to establish a production method that does not use hexavalent chromium also in the field of surface-treated steel sheets used for containers, etc.

As a method of forming a surface-treated steel sheet without using hexavalent chromium, for example, the method proposed in PTLs 4 and 5 is known. In this method, a surface treatment layer is formed by electrolytic treatment in an electrolyte containing a trivalent chromium compound such as basic chromic sulfate.

CITATION LIST

Patent Literature

PTL 1: JPS58-110695
PTL 2: JPS55-134197
PTL 3: JPS57-035699
PTL 4: JP2016-505708
PTL 5: JP2015-520794

SUMMARY

Technical Problem

According to the method proposed in PTLs 4 and 5, a surface treatment layer can be formed without using hexavalent chromium. Then, according to PTLs 4 and 5, the above method can obtain a surface-treated steel sheet with excellent adhesion to a resin film in a wet environment (hereinafter referred to as "film wet adhesion") and adhesion to a coating material in a wet environment (hereinafter referred to as "coating secondary adhesion").

However, although the surface-treated steel sheet obtained by the conventional method as proposed in PTLs 4 and 5 has excellent film wet adhesion and coating secondary adhesion, its corrosion resistance when covered with a resin film (hereinafter referred to as "film corrosion resistance") and when coated (hereinafter referred to as "coating corrosion resistance") is inferior, and its performance was not sufficient for use as a replacement for a tin-free steel sheet produced by a method using hexavalent chromium.

Therefore, there is a need for a surface-treated steel sheet that can be produced without using hexavalent chromium and has excellent film wet adhesion and coating secondary adhesion as well as high film corrosion resistance and coating corrosion resistance.

This disclosure has been developed in light of the above circumstances. It could be helpful to provide a surface-treated steel sheet that can be produced without using hexavalent chromium and has excellent film wet adhesion and coating secondary adhesion as well as high film corrosion resistance and coating corrosion resistance.

Solution to Problem

As a result of intensive studies made to achieve the above object, we discovered the following (1) and (2).

(1) In a surface-treated steel sheet having a metallic Cr layer and a Cr oxide layer disposed on the metallic Cr layer, controlling each of the water contact angle and the total atomic ratio of K, Na, Mg, and Ca adsorbed on the surface to Cr within a specific range can obtain a surface-treated steel sheet with excellent adhesion and corrosion resistance.

(2) The above surface-treated steel sheet can be produced by performing cathodic electrolysis treatment using an electrolyte containing trivalent chromium ions prepared by a specific method, and then performing the last water washing using water with an electrical conductivity of a predetermined value or less.

This disclosure has been made based on the aforementioned discoveries. We thus provide:

1. A surface-treated steel sheet having: a steel sheet; a metallic Cr layer disposed on at least one surface of the steel sheet; and a Cr oxide layer disposed on the metallic Cr layer, the surface-treated steel sheet having:
   - a water contact angle of 500 or less; and
   - a total atomic ratio of K, Na, Mg, and Ca adsorbed on the surface to Cr of 5% or less.

2. The surface-treated steel sheet according to 1. above, wherein the metallic Cr layer has a thickness of 3 nm to 100 nm.

3. The surface-treated steel sheet according to 1. or 2. above, wherein the Cr oxide layer has a thickness of 0.5 nm to 15 nm.

4. The surface-treated steel sheet according to 1. to 3. above, having an atomic ratio of Fe on the surface of the surface-treated steel sheet to Cr of 15% or less.

5. A method of producing a surface-treated steel sheet having: a steel sheet; a metallic Cr layer disposed on at least one surface of the steel sheet; and a Cr oxide layer disposed on the metallic Cr layer, the method comprising:
   - an electrolyte preparation process to prepare an electrolyte containing trivalent chromium ions;
   - a cathodic electrolysis treatment process to subject a steel sheet to cathodic electrolysis treatment in the electrolyte; and
   - a water washing process to subject the steel sheet after the cathodic electrolysis treatment to water washing at least once;

wherein, in the electrolyte preparation process, the electrolyte is prepared by:

mixing a trivalent chromium ion source, a carboxylic acid compound, and water; and adjusting the pH to 4.0 to 7.0 and the temperature to 40° C. to 70° C., and in the water washing process, at least the last water washing uses water with an electrical conductivity of 100 μS/m or less.

Advantageous Effect

This disclosure can provide a surface-treated steel sheet that has excellent film wet adhesion and coating secondary adhesion as well as high film corrosion resistance and coating corrosion resistance. The surface-treated steel sheet of this disclosure can be suitably used as a material for a container, etc.

DETAILED DESCRIPTION

The following provides details of a method of carrying out this disclosure. The following description merely presents examples of preferred embodiments of this disclosure, and this disclosure is not limited to these embodiments.

A surface-treated steel sheet in one of the disclosed embodiments is a surface-treated steel sheet having a steel sheet, a metallic Cr layer disposed on at least one surface of the steel sheet, and a Cr oxide layer disposed on the metallic Cr layer. In this disclosure, it is important that the surface-treated steel sheet have a water contact angle of 50° or less and a total atomic ratio of K, Na, Mg, and Ca adsorbed on the surface to Cr of 5% or less. The following describes each of the features of the surface-treated steel sheet.

[Steel Sheet]

Any steel sheet can be used as the steel sheet without any particular limitation. However, it is preferable to use a steel sheet for can. For example, an ultra low carbon steel sheet or a low carbon steel sheet can be used as the steel sheet. A method of producing the steel sheet is also not particularly limited. A steel sheet produced by any method can be used. However, a cold-rolled steel sheet may be usually used. The cold-rolled steel sheet can be produced by general production processes, for example, including hot rolling, acid cleaning, cold rolling, annealing, and temper rolling.

The chemical composition of the steel sheet is not particularly limited. However, the Cr content is preferably 0.10 mass % or less, and more preferably 0.08 mass % or less. If the Cr content of the steel sheet for can is within the above range, there will be no excessive Cr concentration on the surface of the steel sheet. Consequently, the atomic ratio of Fe to Cr on the surface of the finally obtained surface-treated steel sheet can be 15% or less. In addition, the steel sheet may contain C, Mn, P, S, Si, Cu, Ni, Mo, Al, and inevitable impurities to the extent that the effects in the scope of this disclosure are not impaired. In this case, for example, a steel sheet having a chemical composition specified in ASTM A623M-09 can be suitably used as the steel sheet.

In one of the embodiments, it is preferable to use a steel sheet having a chemical composition containing, in mass %:

C: 0.0001% to 0.13%;
Si: 0% to 0.020%;
Mn: 0.01% to 0.60%;
P: 0% to 0.020%;
S: 0% to 0.030%;
Al: 0% to 0.20%;
N: 0% to 0.040%;
Cu: 0% to 0.20%;
Ni: 0% to 0.15%;
Cr: 0% to 0.10%;
Mo: 0% to 0.05%;
Ti: 0% to 0.020%;
Nb: 0% to 0.020%;
B: 0% to 0.020%;
Ca: 0% to 0.020%;
Sn: 0% to 0.020%; and
Sb: 0% to 0.020%;

with the balance being Fe and inevitable impurities. In the above chemical composition, Si, P, S, Al, and N are components that are preferable with lower content, while Cu, Ni, Cr, Mo, Ti, Nb, B, Ca, Sn, and Sb are optional components that can be added.

The thickness of the steel sheet is not particularly limited. However, it is preferably 0.60 mm or less. The "steel sheet" is defined here to include "steel strip".

[Metallic Cr Layer]

A metallic Cr layer is present on the surface of the steel sheet. The metallic Cr layer may be disposed on at least one surface of the steel sheet and also may be disposed on both surfaces. That is, the metallic Cr layer is formed directly on the surface of the steel sheet.

The thickness of the metallic Cr layer is not particularly limited. However, from the viewpoint of further improving the corrosion resistance, the thickness of the metallic Cr layer is preferably 3 nm or more, more preferably 4 nm or more, and further preferably 5 nm or more. On the other hand, no particular upper limit is also placed on the thickness of the metallic Cr layer. However, if the metallic Cr layer is excessively thick, the water contact angle, as described below, may increase to impair the adhesion. Therefore, from the viewpoint of more stably ensuring the adhesion, the thickness of the metallic Cr layer is preferably 100 nm or less, more preferably 90 nm or less, and further preferably 80 nm or less. The thickness of the metallic Cr layer can be measured by a method described in Examples, using X-ray photoelectron spectroscopy (XPS).

Metallic Cr that constitutes the metallic Cr layer may be amorphous Cr or crystalline Cr. That is, the metallic Cr layer can contain one or both of amorphous Cr and crystalline Cr. The metallic Cr layer produced by the method described below generally contains amorphous Cr and may also contain crystalline Cr. The formation mechanism of the metallic Cr layer is not clear. However, it is thought that partial crystallization proceeds during the formation of amorphous Cr, resulting in a metallic Cr layer containing both amorphous and crystalline phases.

The ratio of crystalline Cr to the sum of amorphous Cr and crystalline Cr contained in the metallic Cr layer is preferably 0% or more and 80% or less, and more preferably 0% or more and 50% or less. The ratio of crystalline Cr can be measured by observing the metallic Cr layer with a scanning transmission electron microscope (STEM). Specifically, first, a STEM image is obtained at a magnification of 2 million times to 10 million times at a beam diameter that provides a resolution of 1 nm or less. In the obtained STEM image, the area where the lattice fringes can be seen is the crystalline phase, and the area where the maze pattern can be seen is the amorphous phase, and the areas of both are determined. From this result, the ratio of the area of crystalline Cr to the total area of amorphous Cr and crystalline Cr is calculated.

[Cr Oxide Layer]

A Cr oxide layer is present on the metallic Cr layer. The thickness of the Cr oxide layer is not particularly limited.

However, it is preferably 0.5 nm or more. The thickness of the Cr oxide layer is preferably 15 nm or less. The thickness of the Cr oxide layer can be measured by the method described in Examples, using XPS.

One or both of the above metallic Cr layer and Cr oxide layer may contain C. No particular upper limit is placed on the C content in the metallic Cr layer. However, the atomic ratio of C to Cr is preferably 50% or less, and more preferably 45% or less. Similarly, no particular upper limit is placed on the C content in the Cr oxide layer. However, the atomic ratio of C to Cr is preferably 50% or less, and more preferably 45% or less. The metallic Cr and the Cr oxide layer may not contain C. Therefore, no particular lower limit is placed on the atomic ratio of C to Cr contained in each of the metallic Cr layer and the Cr oxide layer, and it may be 0%.

The C content in each of the metallic Cr layer and the Cr oxide layer is not particularly limited. However, it can be measured, for example, by XPS. That is, the C content in the metallic Cr layer may be obtained by performing sputtering from the topmost surface to a value equal to ½ the thickness of the metallic Cr layer plus the thickness of the Cr oxide layer, quantifying the atomic ratio using the relative sensitivity factor method from the integrated intensity of the Cr2p and C1s narrow spectra, and calculating C atomic ratio/Cr atomic ratio. The C content in the Cr oxide layer may be obtained by performing sputtering from the topmost surface to a value of ½ the thickness of the Cr oxide layer, quantifying the atomic ratio using the relative sensitivity factor method from the integrated intensity of the Cr2p and C1s narrow spectra, and calculating C atomic ratio/Cr atomic ratio. For the measurement, for example, a scanning X-ray photoelectron spectrometer PHI X-tool made by ULVAC-PHI can be used. The X-ray source is monochrome AlKα ray, the voltage is 15 kV, the beam diameter is 100 μmφ, and the extraction angle is 45°. The sputtering conditions may be Ar ions at an acceleration voltage of 1 kV, and the sputtering rate may be 1.50 nm/min in terms of $SiO_2$.

The mechanism by which C is contained in the metallic Cr layer and the Cr oxide layer is not clear. However, it is thought that a carboxylic acid compound contained in an electrolyte are decomposed to be incorporated into the layers during the process of forming the metallic Cr layer and the Cr oxide layer on the steel sheet.

The existence form of C in the metallic Cr layer and the Cr oxide layer is not particularly limited. However, if C presents as precipitates, the corrosion resistance may be reduced due to the formation of local batteries. Therefore, the sum of the volume fractions of carbides and clusters with a well-defined crystal structure is preferably 10% or less, and more preferably, they are not contained at all (0%). The presence or absence of carbides can be confirmed, for example, by composition analysis using energy dispersive X-ray spectroscopy (EDS) or wavelength dispersive X-ray spectroscopy (WDS) attached to a scanning electron microscope (SEM) or a transmission electron microscope (TEM). The presence or absence of clusters can be confirmed, for example, by performing cluster analysis on the data after three-dimensional composition analysis using a three-dimensional atom probe (3DAP).

One or both of the above metallic Cr layer and Cr oxide layer may contain Fe. The Fe content in each layer is not particularly limited. However, the atom ratio of Fe to Cr is preferably less than 100%. The metallic Cr layer and the Cr oxide layer may not contain Fe. Therefore, no particular lower limit is placed on the atomic ratio of Fe to Cr in each layer, and it may be 0%.

The Fe content on the surface of the surface-treated steel sheet, i.e., the surface of the Cr oxide layer, is not particularly limited. However, a lower Fe content makes the adhesion and the corrosion resistance excellent. Therefore, the atomic ratio of Fe to Cr on the surface of the surface-treated steel sheet is preferably 15% or less, and more preferably 10% or less. A lower atomic ratio is better. Thus, the lower limit may be 0%, and the atomic ratio is most preferably 0%.

The Fe content in the metallic Cr layer and the Cr oxide layer can be measured by XPS, similarly to the C content. The atomic ratio of Fe to Cr on the surface of the surface-treated steel sheet, i.e., the surface of the Cr oxide layer, can be measured by XPS on the surface of the surface-treated steel sheet. The Cr2p and Fe2p narrow spectra may be used to calculate the atomic ratio.

The mechanism by which Fe is contained in the metallic Cr layer and the Cr oxide layer is not clear. However, it is thought that Fe contained in the steel sheet dissolves in the electrolyte in minute amounts to be incorporated into the layers during the process of forming the metallic Cr layer and the Cr oxide layer on the steel sheet.

The metallic Cr layer may contain O. No particular upper limit is placed on the O content in the metallic Cr layer. However, if the O content is high, Cr oxide may precipitate to decrease the corrosion resistance due to the formation of local batteries. Therefore, the O content in the metallic Cr layer, as the atomic ratio of O to Cr, is preferably 30% or less, and more preferably 25% or less. The metallic Cr layer may not contain O. Therefore, no particular lower limit is placed on Cr contained in the metallic Cr layer, and it may be 0%.

The O content in the metallic Cr layer can be measured by compositional analysis such as EDS and WDS, attached to a SEM and a TEM, or 3DAP.

In addition to Cr, O, Fe, and C, and K, Na, Mg, and Ca described below, the above metallic Cr layer and Cr oxide layer may contain metallic impurities such as Cu, Zn, and Ni contained in an aqueous solution, and S, N, Cl, Br, etc. However, the presence of those elements may reduce the corrosion resistance and the adhesion. Therefore, the atomic ratio of the sum of elements other than Cr, O, Fe, C, K, Na, Mg, and Ca to Cr is preferably 3% or less, and more preferably, they are not contained at all (0%). The content of the above elements is not particularly limited. However, it can be measured by, for example, XPS, similarly to the C content.

The above metallic Cr layer and Cr oxide layer are preferably crack-free. The presence or absence of cracks can be confirmed, for example, by cutting out a cross-section of the layer with a focused ion beam (FIB) or the like and directly observing it with a transmission electron microscope (TEM).

The surface roughness of the surface-treated steel sheet of this disclosure is not significantly changed by the formation of the metallic Cr layer and the Cr oxide layer, and is usually about the same as the surface roughness of the used base steel sheet. The surface roughness of the surface-treated steel sheet is not particularly limited. However, the arithmetic mean roughness Ra is preferably 0.1 μm or more and 4 μm or less. The ten-point average roughness Rz is preferably 0.2 μm or more and 6 μm or less.

[Water Contact Angle]

In this disclosure, it is important that the surface-treated steel sheet have a water contact angle of 50° or less. Highly hydrophilizing the surface of the surface-treated steel sheet so that the water contact angle is 50° or less forms strong hydrogen bond between the resin contained in the film or the coating material and the surface-treated steel sheet, resulting in high adhesion even in a wet environment. From the viewpoint of further improving the adhesion, the water contact angle is preferably 48° or less, and more preferably 45° or less. A lower water contact angle is preferable from the viewpoint of improving the adhesion. Thus, no particular lower limit is placed on the water contact angle, and it may be 0°. However, from the viewpoint of ease of production, etc., it may be 5° or more, or even 8° or more. The water contact angle can be measured by the method described in Examples.

The mechanism by which the surface of the surface-treated steel sheet is hydrophilized is not clear. However, it is thought to be because carboxylic acids or carboxylates contained in the electrolyte are decomposed to be incorporated into the layers during the process of forming the metallic Cr layer and the Cr oxide layer by cathodic electrolysis in the electrolyte, thereby imparting hydrophilic functional groups such as carboxyl groups to the surface. However, if the electrolyte is not prepared under specific conditions as described below, the surface of the surface-treated steel sheet will not be hydrophilized even when the electrolyte contains carboxylic acids or carboxylates. The mechanism by which the electrolyte preparation conditions affect the hydrophilization of the surface of the surface-treated steel sheet is not clear. However, it is assumed to be due to the formation of complexes such that hydrophilic functional groups such as carboxyl groups are likely to be imparted to the surface, when the electrolyte is properly prepared under the conditions described below.

In a surface-treated steel sheet produced using conventional hexavalent chromium baths as proposed in PTLs 1 to 3, it has been reported that the composition of the chromium hydrated oxide layer present in the surface layer has a significant effect on the adhesion to the coating material or the film in a wet environment. In a wet environment, water that has penetrated through the coating layer or the film will inhibit the adhesion at the interface between the coating layer or the film and the chromium hydrated oxide layer. Therefore, it was thought that when hydrophilic OH groups are present in large numbers in the chromium hydrated oxide layer, spreading wetting of water at the interface is promoted to reduce adhesive strength. Therefore, in the conventional surface-treated steel sheet, the decrease in OH groups due to the progression of oxonation of chromium hydrated oxides, i.e., hydrophobization of the surface, improves the adhesion to the coating material or the film in a wet environment.

In contrast, this disclosure is based on a technical concept that is completely opposite to the above conventional technology, which is to form strong hydrogen bonds at the interface between the coating layer or the film and the surface-treated steel sheet by hydrophilizing the surface to a near superhydrophilic level, thereby maintaining high adhesion even in a wet environment.

[Atomic Ratio of Adsorbed Element]

As described above, the surface-treated steel sheet of this disclosure has a high hydrophilic property with a water contact angle of 50° or less, and its surface is chemically active. Therefore, cations of elements such as K, Na, Mg, and Ca are likely to be adsorbed on the surface of the surface-treated steel sheet. We have found that simply setting the water contact angle to 50° or less does not provide the original adhesion due to the effect of the adsorbed cations. In this disclosure, reducing the amount of the cations adsorbed on the surface of the surface-treated steel sheet improves the adhesion to the resin, resulting in excellent film wet adhesion and coating secondary adhesion as well as high film corrosion resistance and coating corrosion resistance.

Specifically, the total atomic ratio of K, Na, Mg, and Ca adsorbed on the surface of the surface-treated steel sheet to Cr is 5% or less, preferably 3% or less, and more preferably 1% or less. A lower total atomic ratio is better. Thus, no particular lower limit is placed, and the total atomic ratio may be 0%. The total atomic ratio can be measured by the method described in Examples.

[Production Method]

In a method of producing a surface-treated steel sheet in one of the embodiments, a surface-treated steel sheet with the above characteristics can be produced by the method described below.

The method of producing a surface-treated steel sheet in one of the embodiments is a method of producing a surface-treated steel sheet having a steel sheet, a metallic Cr layer disposed on at least one surface of the steel sheet, and a Cr oxide layer disposed on the metallic Cr layer, and the method includes the following processes (1) to (3). The following describes each process.

(1) Electrolyte preparation process to prepare an electrolyte containing trivalent chromium ions
(2) Cathodic electrolysis treatment process to subject a steel sheet to cathodic electrolysis treatment in the electrolyte
(3) Water washing process to subject the steel sheet after the cathodic electrolysis treatment to water washing at least once

[Electrolyte Preparation Process]

(i) Mixing

In the above electrolyte preparation process, first, a trivalent chromium ion source, a carboxylic acid compound, and water are mixed to form an aqueous solution.

Any compound that can supply trivalent chromium ions can be used as the trivalent chromium ion source. For example, at least one selected from the group consisting of chromium chloride, chromium sulfate, and chromium nitrate can be used as the trivalent chromium ion source.

The content of trivalent chromium ion-containing source in the aqueous solution is not particularly limited. However, it is preferably 3 g/L or more and 50 g/L or less, and more preferably 5 g/L or more and 40 g/L or less in terms of trivalent chromium ions. BluCr® (BluCr is a registered trademark in Japan, other countries, or) TFS A made by Atotech can be used as the trivalent chromium ion source.

Any carboxylic acid compound can be used as the carboxylic acid compound without any particular limitation. The carboxylic acid compound may be at least one of carboxylic acid and carboxylate, and it is preferably at least one of aliphatic carboxylic acid and aliphatic carboxylate. The carbon number of the aliphatic carboxylic acid is preferably 1 or more and 10 or less, and more preferably 1 or more and 5 or less. The carbon number of the aliphatic carboxylate is preferably 1 or more and 10 or less, and more preferably 1 or more and 5 or less. The content of the carboxylic acid compound is not particularly limited. However, it is preferably 0.1 mol/L or more and 5.5 mol/L or less, and more preferably 0.15 mol/L or more and 5.3 mol/L or less. BluCr® TFS B made by Atotech can be used as the carboxylic acid compound.

In this disclosure, water is used as a solvent for preparing the electrolyte. As the water, it is preferable to use highly pure water such as ion-exchanged water in which cations have been removed in advance with ion-exchange resins, etc., or distilled water. As described below, from the viewpoint of reducing the amount of K, Na, Mg, and Ca contained in the electrolyte, it is preferable to use water with an electrical conductivity of 30 μS/m or less.

To reduce the amount of K, Na, Mg, and Ca adsorbed on the surface of the surface-treated steel sheet, it is preferable to intentionally not contain K, Na, Mg, and Ca in the above aqueous solution. Therefore, it is preferable not to contain K, Na, Mg, and Ca in the components added to the aqueous solution, such as the above trivalent chromium ion source and carboxylic acid compounds, and a pH adjuster detailed below. As the pH adjuster, it is preferable to use hydrochloric acid, sulfuric acid, nitric acid, etc. to decrease the pH and to use ammonia water, etc. to increase the pH. K, Na, Mg, and Ca unavoidably mixed in the aqueous solution or the electrolyte are acceptable. However, the total of K, Na, Mg, and Ca is preferably 2.0 mol/L or less, more preferably 1.5 mol/L or less, and further preferably 1.0 mol/L or less.

To effectively suppress the formation of hexavalent chromium at the anode in the cathodic electrolysis treatment process and to improve the stability of the above electrolyte, it is preferable to further contain at least one kind of halide ion in the above aqueous solution. The content of halide ion is not particularly limited. However, it is preferably 0.05 mol/L or more and 3.0 mol/L or less, and more preferably 0.10 mol/L or more and 2.5 mol/L or less. BluCr® TFS C1 and BluCr® TFS C2 made by Atotech can be used to contain the halide ion.

It is preferable not to add hexavalent chromium to the above aqueous solution. With the exception of a very small amount of hexavalent chromium formed at the anode in the cathodic electrolysis treatment process, no hexavalent chromium is contained in the above electrolyte. The very small amount of hexavalent chromium formed at the anode in the cathodic electrolysis treatment process is reduced to trivalent chromium. Thus, the concentration of hexavalent chromium in the electrolyte does not increase.

It is preferable not to intentionally add metal ions other than trivalent chromium ions to the above aqueous solution. The metal ions are not limited, but include Cu ions, Zn ions, Ni ions, etc. Each content is preferably 0 mg/L or more and 40 mg/L or less, more preferably 0 mg/L or more and 20 mg/L or less, and most preferably 0 mg/L or more and 10 mg/L or less. Of the above metal ions, Fe ions may dissolve in the electrolyte to co-deposit in the layer when the steel sheet is immersed in the above electrolyte during the cathodic electrolysis treatment process. However, this does not affect the film corrosion resistance and the coating corrosion resistance, as well as the film wet adhesion and the coating secondary adhesion. The content of Fe ions is preferably 0 mg/L or more and 40 mg/L or less, more preferably 0 mg/L or more and 20 mg/L or less, and most preferably 0 mg/L or more and 10 mg/L or less. The Fe ion concentration is preferably in the above range during the initial make-up of electrolytic bath. However, it is preferable to maintain the Fe ion concentration in the electrolyte in the above range also during the cathodic electrolysis treatment process.

(ii) Adjustment of pH and Temperature

Next, the electrolyte is prepared by adjusting the pH of the aqueous solution to 4.0 to 7.0 and the temperature of the aqueous solution to 40° C. to 70° C. To produce the above surface-treated steel sheet, simply dissolving the trivalent chromium ion source and the carboxylic acid compound in water is not enough. It is important to properly control the pH and the temperature as described above.

pH: 4.0 to 7.0

In the electrolyte preparation process, the pH of the aqueous solution after mixing is adjusted to 4.0 to 7.0. When the pH is less than 4.0 or greater than 7.0, the water contact angle of the surface-treated steel sheet produced using the resulting electrolyte is higher than 50°. The pH is preferably 4.5 or more and 6.5 or less.

Temperature: 40° C. to 70° C.

In the electrolyte preparation process, the temperature of the aqueous solution after mixing is adjusted to 40° C. to 70° C. If the temperature is less than 40° C. or greater than 70° C., the water contact angle of the surface-treated steel sheet produced using the resulting electrolyte is greater than 50°. The holding time in the temperature range of 40° C. to 70° C. is not particularly limited.

The above procedure can obtain the electrolyte to be used in the next cathodic electrolysis treatment process. The electrolyte produced by the above procedure can be stored at room temperature.

[Cathodic Electrolysis Treatment Process]

Next, the steel sheet is subjected to the cathodic electrolysis treatment in the electrolyte obtained in the above electrolyte preparation process. The cathodic electrolysis treatment can form a metallic Cr layer and a Cr oxide layer on at least one surface of the base steel sheet.

The temperature of the electrolyte during the cathodic electrolysis treatment is not particularly limited. However, it is preferably in the temperature range of 40° C. or more and 70° C. or less to efficiently form the metallic Cr layer and the Cr oxide layer. From the viewpoint of stably producing the above surface-treated steel sheet, it is preferable to monitor the temperature of the electrolyte and maintain it in the above temperature range during the cathodic electrolysis treatment process.

The pH of the electrolyte during the cathodic electrolysis treatment is not particularly limited. However, it is preferably 4.0 or more, and more preferably 4.5 or more. The pH is preferably 7.0 or less, and more preferably 6.5 or less. From the viewpoint of stably producing the above surface-treated steel sheet, it is preferable to monitor the pH of the electrolyte and maintain it in the above pH range during the cathodic electrolysis treatment process.

The current density in the cathodic electrolysis treatment is not particularly limited and may be appropriately adjusted to form a desired surface treatment layer. However, an excessively high current density places an excessive burden on a cathodic electrolysis treatment device. Therefore, the current density is preferably 200.0 A/dm$^2$ or less, and more preferably 100 A/dm$^2$ or less. No particular lower limit is also placed on the current density. However, excessively low current density may generate hexavalent Cr in the electrolyte to impair the stability of the bath. Therefore, the current density is preferably 5.0 A/dm$^2$ or more, and more preferably 10.0 A/dm$^2$ or more.

The number of times the steel sheet is subjected to the cathodic electrolysis treatment is not particularly limited and can be any number of times. In other words, the cathodic electrolysis treatment can be performed using an electrolysis treatment device having one or two or more any number of passes. For example, it is also preferable to perform the cathodic electrolysis treatment continuously by passing the steel sheet (steel strip) through a plurality of passes while conveying it. The increased number of times of the cathodic electrolysis treatment (i.e., the number of passes) requires a commensurate number of electrolytic cells. Thus, the number of times of the cathodic electrolysis treatment (the number of passes) is preferably 20 or less.

The electrolysis time per pass is not particularly limited. However, if the electrolysis time per pass is too long, the steel sheet transport speed (line speed) is reduced to decrease productivity. Therefore, the electrolysis time per pass is preferably 5 seconds or less, and more preferably 3 seconds or less. No particular lower limit is also placed on the electrolysis time per pass. However, if the electrolysis time is excessively short, the line speed needs to be increased accordingly, making its control difficult. Therefore, the electrolysis time per pass is preferably 0.005 seconds or more, and more preferably 0.01 seconds or more.

The thickness of the metallic Cr layer formed by the cathodic electrolysis treatment can be controlled by the total electrical density, expressed as the product of the current density, the electrolysis time, and the number of passes. As described above, if the metallic Cr layer is excessively thick, the water contact angle may increase to impair the adhesion. From the viewpoint of more stably ensuring the adhesion, it is preferable to control the total electrical density so that the thickness of the metallic Cr layer is 100 nm or less. However, the relationship between the thickness of the metallic Cr layer and the total electrical density varies with the configuration of the device used in the cathodic electrolysis treatment process. Thus, the actual electrolysis treatment conditions may be adjusted according to the device.

The type of the anode used when performing the cathodic electrolysis treatment is not particularly limited, and any anode can be used. It is preferable to use an insoluble anode as the anode. As the insoluble anode, it is preferable to use at least one selected from the group consisting of an anode obtained by coating Ti with one or both of a platinum group metal and an oxide of the platinum group metal, and a graphite anode. More specifically, an example of the insoluble anode is an anode obtained by coating the surface of Ti as a substrate with platinum, iridium oxide, or ruthenium oxide.

In the above cathodic electrolysis treatment process, the concentration of the electrolyte is constantly changing due to the formation of the metallic Cr layer and the Cr oxide layer on the steel sheet, bringing in and out of the solution, and evaporation of water. The change in concentration of the electrolyte in the cathodic electrolysis treatment process vary with the configuration of the device and production conditions. Thus, from the viewpoint of more stably producing the surface-treated steel sheet, it is preferable to monitor the concentration of the components contained in the electrolyte and maintain it in the above concentration range during the cathodic electrolysis treatment process.

The steel sheet can be optionally pretreated prior to the cathodic electrolysis treatment. Any treatment can be performed as the pretreatment. However, it is preferable to perform at least one of degreasing, acid cleaning, and water washing.

Degreasing can remove rolling oil, antirust oil, etc. attached to the steel sheet. The degreasing can be performed by any method with no particular limitation. After the degreasing, it is preferable to perform water washing to remove the degreasing treatment solution attached to the steel sheet surface.

Acid cleaning can remove the natural oxide film present on the surface of the steel sheet to activate the surface. The acid cleaning can be performed by any method with no particular limitation. After the acid cleaning, it is preferable to perform water washing to remove the acid cleaning solution attached to the steel sheet surface.

[Water Washing Process]

Next, the steel sheet after the above cathodic electrolysis treatment is subjected to water washing at least once. Water washing can remove the electrolyte remaining on the surface of the steel sheet. The water washing can be performed by any method with no particular limitation. For example, a water washing tank can be installed downstream of the electrolytic cell for performing the cathodic electrolysis treatment to continuously immerse the steel sheet after the cathodic electrolysis treatment in water. The water washing may also be performed by spraying water on the steel sheet after the cathodic electrolysis treatment with a spray.

The number of times water washing is performed is not particularly limited and may be one, or two or more. However, to avoid an excessively large number of water washing tanks, the number of times of water washing is preferably 5 or less. If water washing treatment is performed twice or more, each water washing may be performed in the same or different manner.

In this disclosure, it is important to use water with an electrical conductivity of 100 μS/m or less for at least the last water washing in the water washing treatment process. This can reduce the amount of K, Na, Mg, and Ca adsorbed on the surface of the surface-treated steel sheet, resulting in the improved adhesion. The water with an electrical conductivity of 100 μS/m or less can be produced by any method. The water with an electrical conductivity of 100 μS/m or less may be, for example, ion-exchanged water or distilled water.

When water washing is performed twice or more in the water washing treatment process, the above effect can be obtained by using the water with an electrical conductivity of 100 μS/m or less for the last water washing. Thus, any water can be used for the water washing other than the last water washing. The water with an electrical conductivity of 100 μS/m or less may be also used for the water washing other than the last water washing. However, from the viewpoint of cost reduction, it is preferable to use the water with an electrical conductivity of 100 μS/m or less only for the last water washing and to use normal water, such as tap water or industrial water, for the water washing other than the last water washing.

From the viewpoint of further reducing the amount of K, Na, Mg, and Ca adsorbed on the surface of the surface-treated steel sheet, the electrical conductivity of the water used for the last water washing is preferably 50 μS/m or less, and more preferably 30 μS/m or less.

The temperature of the water used for the water washing treatment is not particularly limited and may be any temperature. However, excessively high temperatures place an excessive burden on water washing equipment. Thus, the temperature of the water used for water washing is preferably 95° C. or less. On the other hand, no particular lower limit is also placed on the temperature of the water used for water washing. However, it is preferably 0° C. or more. The temperature of the water used for water washing may be room temperature.

The water washing time per water washing treatment is not particularly limited. However, from the viewpoint of increasing the effect of the water washing treatment, it is preferably 0.1 seconds or more, and more preferably 0.2 seconds or more. No particular upper limit is also placed on the water washing time per water washing treatment. However, at the production on a continuous line, it is preferably 10 seconds or less, and more preferably 8 seconds or less because the line speed is reduced to decrease the productivity.

After the above water washing treatment process, drying may be optionally performed. The drying method is not particularly limited. For example, ordinary dryer or electric furnace drying methods can be applied. The temperature for the drying process is preferably 100° C. or less. The temperature within the above range can suppress the transformation of the surface-coating layer. No particular lower limit is placed. However, it is usually around room temperature.

The applications of the surface-treated steel sheet of this disclosure are not particularly limited. However, the surface-treated steel sheet is particularly suitable as a surface-treated steel sheet for container used in the production of various types of containers, such as food cans, beverage cans, pails, and 18-liter cans.

EXAMPLES

To determine the effect of this disclosure, surface-treated steel sheets were produced in the following procedures and their characteristics were evaluated.

(Electrolyte Preparation Process)

First, electrolytes having compositions A to G presented in Table 1 were prepared under the respective conditions presented in Table 1. That is, the respective components presented in Table 1 were mixed with water to form aqueous solutions, and then each aqueous solution was adjusted to the pH and the temperature presented in Table 1. Electrolyte G is equivalent to the electrolyte used in the example in PTL 4. For increasing the pH, ammonia water was used in each case. For decreasing the pH, sulfuric acid was used for Electrolytes A, B, and G, hydrochloric acid was used for Electrolytes C and D, and nitric acid was used for Electrolytes E and F.

(Pretreatment on Steel Sheet)

Steel sheets were pretreated prior to the subsequent cathodic electrolysis treatment process. The pretreatment included electrolytic degreasing, water washing, acid cleaning by immersion in dilute sulfuric acid, and water washing, in sequence. As each steel sheet, a steel sheet for can (T4 base sheet) was used, having a Cr content in mass % of each value presented in Tables 2 and 4 and a thickness of 0.22 mm.

(Cathodic Electrolysis Treatment Process)

Subsequently, each steel sheet after the pretreatment was subjected to the cathodic electrolysis treatment under each conditions presented in Tables 2 and 4. Each electrolyte in the cathodic electrolysis treatment was maintained at each pH and temperature presented in Table 1. The electrical density during the cathodic electrolysis treatment was set to 40 A/dm$^2$, and the electrolysis time and the number of passes were appropriately varied. An insoluble anode obtained by coating Ti as a substrate with iridium oxide was used as the anode during the cathodic electrolysis treatment. After the cathodic electrolysis treatment was performed, each steel sheet was subjected to the water washing treatment and then dried at room temperature using a blower.

(Water Washing Process)

Next, each steel sheet after the above cathodic electrolysis treatment was subjected to the water washing treatment. The water washing treatment was performed one time to five times under each conditions presented in Tables 2 and 4. The method of each water washing and the electrical conductivity of the used water are presented in Tables 2 and 4.

For each of the obtained surface-treated steel sheets, the thickness of the Cr oxide layer, the thickness of the metallic Cr layer, the water contact angle, the atomic ratio of adsorbed element, and the Fe atomic ratio were measured using the following procedures. The measurement results are presented in Tables 3 and 5.

(Thickness of Cr Oxide Layer)

The thickness of the Cr oxide layer was measured by XPS. Specifically, the Cr2p narrow spectrum was separated into three peaks each corresponding to metallic Cr, Cr oxide, and Cr hydroxide from the lowest bonding energy, to calculate the integrated intensity ratio. The measurement was taken every 2 nm from the topmost layer until the sum of the integrated intensities of the Cr oxide peak and the Cr hydroxide peak became less than the integrated intensity of the metallic Cr peak. The relationship of integrated intensity of metallic Cr peak/(integrated intensity of Cr oxide peak+integrated intensity of Cr hydroxide peak) with respect to the depth from the topmost layer was linearly approximated using the least-squares method. Then, the depth from the topmost layer where integrated intensity of metallic Cr peak/(integrated intensity of Cr oxide peak+integrated intensity of Cr hydroxide peak) is 1 was defined as the thickness of the Cr oxide layer.

The Cr2p narrow spectrum may include peaks corresponding to the bonding energy of C and Cr co-deposited in the metallic Cr layer and the Cr oxide layer. However, it is perfectly acceptable to ignore the peaks corresponding to the bonding energy of C and Cr and separate the Cr2p narrow spectrum into the above three peaks to calculate each thickness of the metallic Cr layer and the Cr oxide layer.

(Thickness of Metallic Cr Layer)

The thickness of the metallic Cr layer was also measured by XPS, similarly to the Cr oxide layer. Specifically, the atomic ratios were quantified by the relative sensitivity factor method from the integral intensity of the Cr2p and Fe2p narrow spectra, and then the measurement was taken every 2 nm from the topmost layer until the Cr atomic ratio became smaller than the Fe atomic ratio. The relationship of Fe atomic ratio/Cr atomic ratio with respect to the depth from the topmost layer was approximated by a cubic formula using the least-squares method. Then, the value obtained by subtracting the thickness of the Cr oxide layer from the depth from the topmost layer where Fe atomic ratio/Cr atomic ratio is 1 was defined as the thickness of the metallic Cr layer. The case where the depth from the topmost layer where above Fe atom ratio/Cr atom ratio is 1 is smaller than the above thickness of the Cr oxide layer means that there is no metallic Cr layer, in which case, sufficient corrosion resistance cannot be obtained.

For the above measurement of the thickness of the Cr oxide layer and the thickness of the metallic Cr layer, a scanning X-ray photoelectron spectrometer PHI X-tool made by ULVAC-PHI was used. The X-ray source was monochrome AlKα ray, the voltage was 15 kV, the beam diameter was 100 μmφ, and the extraction angle was 45°. The sputtering conditions are Ar ions at an accelerating voltage of 1 kV, and the sputtering rate is 1.50 nm/min in terms of $SiO_2$. For separation into three peaks corresponding to metallic Cr, Cr oxide, and Cr hydroxide, analysis software MultiPak made by ULVAC-PHI was used, background processing by the IntrratedShirley method was performed, and peak fitting by the Gauss-Lorentz function was performed. In the peak fitting, Position, FWHM, and % Gauss were entered for each peak to match the spectrum to perform auto-fitting. If the auto-fitting did not converge, the above values were varied until the auto-fitting converged.

(Water Contact Angle)

The water contact angle was measured using an automatic contact angle meter CA-VP model made by Kyowa Surfaces & Technologies. The surface temperature of the surface-treated steel sheet was set to 20° C.±1° C., and distilled water at 20° C.±1° C. was used as water. The distilled water was dropped onto the surface of the surface-treated steel sheet in a 2-μl volume. After 1 second, the contact angle was measured by the θ/2 method. The arithmetic mean value of the contact angle for five drops was defined as the water contact angle.

(Atomic Ratio of Adsorbed Element)

The total atomic ratio of K, Na, Mg, and Ca adsorbed on the surface of the surface-treated steel sheet to Cr was measured by XPS. No sputtering was performed in the measurement. The atomic ratios were quantified by the relative sensitivity factor method from the integrated intensity of the narrow spectra of K2p, Na1s, Ca2p, Mg1s, and Cr2p at the topmost surface of the sample to calculate (K atomic ratio+Na atomic ratio+Ca atomic ratio+Mg atomic ratio)/Cr atomic ratio. For the XPS measurement, a scanning X-ray photoelectron spectrometer PHI X-tool made by ULVAC-PHI was used. The X-ray source was monochrome AlKα ray, the voltage was 15 kV, the beam diameter was 100 μmφ, and the extraction angle was 45°.

(Fe Atom Ratio)

The atomic ratio of Fe to Cr on the surface of the surface-treated steel sheet was measured by XPS. No sputtering was performed in the measurement. The atomic ratios were quantified by the relative sensitivity factor method from the integrated intensity of the Fe2p and Cr2p narrow spectra at the sample surface to calculate Fe atomic ratio/Cr atomic ratio. For the XPS measurement, a scanning X-ray photoelectron spectrometer PHI X-tool made by ULVAC-PHI was used. The X-ray source was monochrome AlKα ray, the voltage was 15 kV, the beam diameter was 100 μmφ, and the extraction angle was 45°.

Furthermore, the resulting surface-treated steel sheets were evaluated for the film corrosion resistance, the coating corrosion resistance, the film wet adhesion, and the coating secondary adhesion by the following methods. The evaluation results are presented in Tables 3 and 5.

(Sample Preparation)

Laminated steel sheets as samples used to evaluate the film corrosion resistance and the film wet adhesion were prepared according to the following procedure.

Each resulting surface-treated steel sheet was laminated on both surfaces with isophthalic acid copolymerized polyethylene terephthalate film with a stretch ratio of 3.1×3.1, a thickness of 25 μm, a copolymerization ratio of 12 mol %, and a melting point of 224° C. to produce a laminated steel sheet. The lamination was performed under conditions where the crystallinity of the resin film was 10% or less, specifically, feed rate of steel sheet: 40 m/min, nip length of rubber roll: 17 mm, and time from crimping to water cooling: 1 sec. The crystallinity of the resin film was determined by the density gradient tube method in accordance with JIS K7112. The nip length is a length in the conveying direction of the area where the rubber roll comes in contact with the steel sheet.

Coated steel sheets as samples used to evaluate the coating corrosion resistance and the coating secondary adhesion were prepared according to the following procedure.

The surface of each resulting surface-treated steel sheet was coated with epoxy phenolic-based coating material and baked at 210° C. for 10 minutes to produce a coated steel sheet. The coating weight was 50 mg/dm$^2$.

(Film Corrosion Resistance, Coating Corrosion Resistance)

Cross cuts were made on the film surface of the produced laminated steel sheet and the coating surface of the coated steel sheet using a cutter to a depth that reaches the steel substrate (steel sheet). The laminated steel sheet and coated steel sheet with crosscuts were immersed in a test solution at 55° C. consisting of a mixed aqueous solution containing 1.5 mass % citric acid and 1.5 mass % salt for 96 hours. After immersion, washing and drying were performed. Then, tape peeling was performed by applying cellophane adhesive tape to the film surface of the laminated steel sheet and the coating surface of the coated steel sheet and then peeling it off. For the film corrosion resistance, the film peeling width (total width of the left and right sides extending from the cut part) was measured at four arbitrary locations at the crosscut part of the laminated steel sheet, and the average value of the four locations was determined and considered as the corrosion width. For the coating corrosion resistance, the coating peeling width (total width of the left and right sides extending from the cut part) was measured at four arbitrary locations at the crosscut part of the coated steel sheet, and the average value of the four locations was determined and considered as the corrosion width. The film corrosion resistance and the coating corrosion resistance were evaluated based on the following criteria. For practical use, a result of ◎, ○, or Δ can be evaluated as having excellent corrosion resistance.

◎: Corrosion width of less than 0.3 mm

○: Corrosion width of 0.3 mm or more and less than 0.5 mm

Δ: Corrosion width of 0.5 mm or more and less than 1.0 mm x: Corrosion width of 1.0 mm or more (Film Wet Adhesion)

Each film wet adhesion was evaluated by the 180° peel test in a retort atmosphere at a temperature of 130° C. and a relative humidity of 100% using the above laminated steel sheets. The specific procedure was as follows.

First, a total of six specimens were cut from each of the above laminated steel sheets, three specimens with the front surface as the target surface and three specimens with the back surface as the target surface. The size of each specimen was 30 mm in width and 100 mm in length. Next, at 15 mm from the top of each specimen in the longitudinal direction, the film on the side opposite the target side and the steel sheet were cut with leaving the film on the target side. For the specimen after cutting, the portion from the bottom to 15 mm in the longitudinal direction of the specimen was fixed so that the steel sheet was perpendicular to the ground, and the portion of 30 mm in width and 15 mm in length above the cut position hanged down with being connected by the film on the target surface. Then, a weight of 100 g was attached to the hanging portion of 30 mm in width and 15 mm in length.

The specimens in this state were left in a retort atmosphere with a temperature of 130° C. and a relative humidity of 100% for 30 minutes and then opened to the air. The length of the film on the target surface peeled off from the surface-treated steel sheet was defined as the film peeling length, and the average value of the film peeling lengths of six specimens was determined for each laminated steel sheet. The determined average value of the film peeling lengths was used to evaluate the film wet adhesion according to the following evaluation criteria. For practical use, a result of ◎, ○, or Δ can be evaluated as having excellent film wet adhesion.

◎: Peeling length of less than 20 mm

○: Peeling length of 20 mm or more and less than 40 mm

Δ: Peeling length of 40 mm or more and less than 60 mm x: Peeling length of 60 mm or more (Coating Secondary Adhesion)

Two coated steel sheets produced under the same conditions were laminated so that the coated surfaces faced one another with a nylon adhesive film in between, and then stacked under crimping conditions of a pressure of $2.94\times10^5$ Pa, a temperature of 190° C., and a crimping time of 30 seconds. It was then divided into specimens with 5 mm in width. The divided specimens were immersed in a test solution at 55° C. consisting of a mixed aqueous solution containing 1.5 mass % citric acid and 1.5 mass % salt for 168 hours. After immersion, washing and drying were performed. Then, the two steel sheets of the divided specimen were pulled apart in a tensile testing machine, and the tensile strength when pulled apart was measured. The average value of three specimens was evaluated using the following criteria. For practical use, a result of ◎, ○, or Δ can be evaluated as having excellent coating secondary adhesion.

◎: 2.5 kgf or more

○: 2.0 kgf or more and less than 2.5 kgf

Δ: 1.5 kgf or more and less than 2.0 kgf x: Less than 1.5 kgf

As is clear from the results presented in Tables 3 and 5, the surface-treated steel sheets meeting the conditions of this disclosure all had excellent film wet adhesion and coating secondary adhesion, as well as high film corrosion resistance and coating corrosion resistance, even though they were produced without using hexavalent chromium.

TABLE 1

| | Electrolyte | A | B | C | D | E | F | G |
|---|---|---|---|---|---|---|---|---|
| Component (mol/L) | $Cr(OH)SO_4 \cdot Na_2SO_4$ | — | — | — | — | — | — | 0.39 |
| | $Cr_2(SO_4)_3$ | 0.1 | 0.2 | — | — | — | — | — |
| | $CrCl_3$ | — | — | 0.2 | 0.5 | — | — | — |
| | $Cr(NO_3)_3$ | — | — | — | — | 0.2 | 0.5 | — |
| | $HCO_2H$ | 4.2 | — | 0.4 | — | 4.8 | — | — |
| | $NH_4CHO_2$ | — | 0.5 | — | 3.5 | — | 0.5 | — |
| | $HCO_2K$ | — | — | — | — | — | — | 0.61 |
| | $NH_4Cl$ | 1.1 | 1.4 | 0.7 | — | 1.5 | — | — |
| | $NH_4Br$ | — | 0.3 | 0.6 | 0.4 | 0.2 | 1.3 | — |
| | KCl | — | — | — | — | — | — | 3.35 |
| | KBr | — | — | — | — | — | — | 0.13 |
| | pH | 5.0 | 5.7 | 5.1 | 4.3 | 6.8 | 5.8 | 2.3 |
| | Temperature (° C.) | 42 | 50 | 65 | 55 | 55 | 53 | 50 |
| | Remarks | Example | Example | Example | Example | Example | Example | Comparative Example |

TABLE 2

| | Production conditions | | | | | | | | |
|---|---|---|---|---|---|---|---|---|---|
| | | | | Water washing treatment | | | | | |
| | Steel sheet | Cathodic electrolysis treatment | | | | | | | |
| | Cr | | Electric | First time | | Second time | | Third time | |
| No. | Content [mass %] | Electrolyte | density [C/dm$^2$] | Method | Conductivity [μS/m] | Method | Conductivity [μS/m] | Method | Conductivity [μS/m] |
| 1 | 0.04 | A | 120 | Immersion | 22 | — | — | — | — |
| 2 | 0.04 | C | 240 | Spray | 7 | — | — | — | — |
| 3 | 0.04 | F | 300 | Spray | 250 | Immersion | 9 | — | — |
| 4 | 0.04 | B | 60 | Spray | 40 | Spray | 12 | — | — |
| 5 | 0.04 | E | 100 | Spray | 5 | Immersion | 83 | Immersion | 7 |
| 6 | 0.04 | D | 80 | Immersion | 3 | Immersion | 6 | Spray | 18 |
| 7 | 0.04 | A | 660 | Spray | 93 | Immersion | 5 | Immersion | 125 |
| 8 | 0.04 | E | 120 | Immersion | 8 | Immersion | 22 | Spray | 77 |
| 9 | 0.04 | D | 160 | Immersion | 23 | Immersion | 15 | Immersion | 276 |
| 10 | 0.04 | F | 1000 | Immersion | 211 | Spray | 165 | Spray | 132 |
| 11 | 0.04 | B | 120 | Immersion | 16 | Immersion | 206 | Spray | 7 |
| 12 | 0.04 | C | 80 | Immersion | 120 | Spray | 114 | Spray | 24 |
| 13 | 0.04 | A | 60 | Immersion | 132 | Immersion | 102 | Immersion | 29 |
| 14 | 0.04 | A | 48 | Immersion | 98 | Immersion | 83 | Spray | 15 |
| 15 | 0.04 | B | 1200 | Immersion | 132 | Immersion | 102 | Immersion | 29 |
| 16 | 0.04 | B | 1400 | Immersion | 98 | Immersion | 83 | Spray | 15 |
| 17 | 0.04 | D | 80 | Immersion | 36 | — | — | — | — |
| 18 | 0.04 | C | 160 | Spray | 42 | — | — | — | — |
| 19 | 0.04 | E | 80 | Immersion | 75 | — | — | — | — |
| 20 | 0.04 | F | 160 | Spray | 66 | — | — | — | — |
| 21 | 0.04 | D | 140 | Immersion | 135 | — | — | — | — |
| 22 | 0.04 | B | 112 | Spray | 113 | — | — | — | — |
| 23 | 0.04 | A | 90 | Immersion | 10 | Immersion | 33 | — | — |
| 24 | 0.04 | F | 100 | Immersion | 12 | Spray | 43 | — | — |
| 25 | 0.04 | D | 90 | Immersion | 10 | Immersion | 55 | — | — |
| 26 | 0.04 | E | 100 | Immersion | 12 | Spray | 82 | — | — |
| 27 | 0.04 | C | 80 | Immersion | 60 | Immersion | 102 | — | — |
| 28 | 0.04 | B | 120 | Immersion | 25 | Spray | 122 | — | — |
| 29 | 0.04 | A | 150 | Immersion | 30 | Immersion | 33 | Immersion | 33 |
| 30 | 0.04 | A | 120 | Spray | 5 | Immersion | 146 | Spray | 43 |

TABLE 2-continued

| | Production conditions Water washing treatment | | | | |
|---|---|---|---|---|---|
| | Fourth time | | Fifth time | | |
| No. | Method | Conductivity [μS/m] | Method | Conductivity [μS/m] | Remarks |
| 1 | — | — | — | — | Example |
| 2 | — | — | — | — | Example |
| 3 | — | — | — | — | Example |
| 4 | — | — | — | — | Example |
| 5 | — | — | — | — | Example |
| 6 | — | — | — | — | Example |
| 7 | Immersion | 2 | — | — | Example |
| 8 | Spray | 16 | — | — | Example |
| 9 | Immersion | 52 | Immersion | 26 | Example |
| 10 | Immersion | 144 | Spray | 8 | Example |
| 11 | — | — | — | — | Example |
| 12 | — | — | — | — | Example |
| 13 | — | — | — | — | Example |
| 14 | — | — | — | — | Example |
| 15 | — | — | — | — | Example |
| 16 | — | — | — | — | Example |
| 17 | — | — | — | — | Example |
| 18 | — | — | — | — | Example |
| 19 | — | — | — | — | Example |
| 20 | — | — | — | — | Example |
| 21 | — | — | — | — | Comparative Example |
| 22 | — | — | — | — | Comparative Example |
| 23 | — | — | — | — | Example |
| 24 | — | — | — | — | Example |
| 25 | — | — | — | — | Example |
| 26 | — | — | — | — | Example |
| 27 | — | — | — | — | Comparative Example |
| 28 | — | — | — | — | Comparative Example |
| 29 | — | — | — | — | Example |
| 30 | — | — | — | — | Example |

TABLE 3

| | Measurement result | | | | | Evaluation | | | | |
|---|---|---|---|---|---|---|---|---|---|---|
| No. | Metallic Cr layer Thickness [nm] | Cr oxide layer Thickness [nm] | Water contact angle [°] | Atomic ratio of adsorbed element *1 [%] | Fe atom ratio *2 [%] | Film corrosion resistance | Coating corrosion resistance | Film wet adhesion | Coating secondary adhesion | Remarks |
| 1 | 8.2 | 1.3 | 22.5 | 0.3 | 0.0 | ◎ | ◎ | ◎ | ◎ | Example |
| 2 | 17.5 | 3.5 | 19.3 | 0.0 | 0.0 | ◎ | ◎ | ◎ | ◎ | Example |
| 3 | 22.3 | 0.5 | 43.0 | 0.0 | 0.0 | ◎ | ◎ | ◎ | ◎ | Example |
| 4 | 5.1 | 2.4 | 31.2 | 0.0 | 2.1 | ◎ | ◎ | ◎ | ◎ | Example |
| 5 | 7.8 | 15.0 | 10.1 | 0.0 | 0.0 | ◎ | ◎ | ◎ | ◎ | Example |
| 0 | 6.2 | 0.6 | 11.3 | 0.0 | 7.3 | ◎ | ◎ | ◎ | ◎ | Example |
| 7 | 50.3 | 0.9 | 29.3 | 0.0 | 0.0 | ◎ | ◎ | ◎ | ◎ | Example |
| 8 | 9.2 | 5.0 | 14.2 | 0.0 | 0.0 | ◎ | ◎ | ◎ | ◎ | Example |
| 9 | 12.1 | 1.0 | 35.6 | 0.0 | 0.0 | ◎ | ◎ | ◎ | ◎ | Example |
| 10 | 78.2 | 11.3 | 41.3 | 0.0 | 0.0 | ◎ | ◎ | ◎ | ◎ | Example |
| 11 | 10.2 | 0.7 | 30.3 | 0.0 | 0.0 | ◎ | ◎ | ◎ | ◎ | Example |
| 12 | 6.8 | 8.2 | 16.5 | 0.2 | 2.2 | ◎ | ◎ | ◎ | ◎ | Example |
| 13 | 4.6 | 4.3 | 23.0 | 0.1 | 5.3 | ○ | ○ | ◎ | ◎ | Example |
| 14 | 3.2 | 3.5 | 18.3 | 0.0 | 8.2 | Δ | Δ | ◎ | ◎ | Example |
| 15 | 85.6 | 4.5 | 46.5 | 0.1 | 0.0 | ◎ | ◎ | ○ | ○ | Example |
| 16 | 98.6 | 3.2 | 49.2 | 0.0 | 0.0 | ◎ | ◎ | Δ | Δ | Example |
| 17 | 6.6 | 2.2 | 31.3 | 1.8 | 1.2 | ○ | ○ | ○ | ○ | Example |
| 18 | 12.1 | 0.6 | 19.8 | 2.6 | 0.0 | ○ | ○ | ○ | ○ | Example |
| 19 | 6.6 | 2.2 | 16.3 | 4.2 | 1.6 | Δ | Δ | Δ | Δ | Example |
| 20 | 12.1 | 2.1 | 26.5 | 3.5 | 0.0 | Δ | Δ | Δ | Δ | Example |
| 21 | 10.5 | 1.5 | 20.0 | 7.2 | 0.0 | X | X | X | X | Comparative Example |
| 22 | 8.3 | 1.4 | 24.3 | 6.2 | 0.0 | X | X | X | X | Comparative Example |
| 23 | 6.7 | 0.5 | 22.5 | 1.9 | 0.0 | ○ | ○ | ○ | ○ | Example |
| 24 | 7.3 | 4.8 | 14.5 | 2.9 | 0.3 | ○ | ○ | ○ | ○ | Example |
| 25 | 6.7 | 9.6 | 23.3 | 3.6 | 1.1 | Δ | Δ | Δ | Δ | Example |
| 26 | 7.3 | 4.8 | 13.2 | 3.7 | 1.2 | Δ | Δ | Δ | Δ | Example |
| 27 | 6.2 | 4.5 | 11.5 | 5.6 | 0.9 | X | X | X | X | Comparative Example |

TABLE 3-continued

| No. | Measurement result: Metallic Cr layer Thickness [nm] | Cr oxide layer Thickness [nm] | Water contact angle [°] | Atomic ratio of adsorbed element *1 [%] | Fe atom ratio *2 [%] | Evaluation: Film corrosion resistance | Coating corrosion resistance | Film wet adhesion | Coating secondary adhesion | Remarks |
|---|---|---|---|---|---|---|---|---|---|---|
| 28 | 8.9 | 2.5 | 21.3 | 6.7 | 0.0 | X | X | X | X | Comparative Example |
| 29 | 11.2 | 7.3 | 13.9 | 2.6 | 0.0 | ○ | ○ | ○ | ○ | Example |
| 30 | 9.3 | 2.9 | 15.3 | 1.2 | 0.0 | ○ | ○ | ○ | ○ | Example |

*1 Total atomic ratio of K, Na, Mg, and Ca adsorbed on the surface to Cr

*2 Atomic ratio of Fe on the surface to Cr

TABLE 4

| No. | Production conditions: Steel sheet: Cr Content [mass %] | Cathodic electrolysis treatment: Electrolyte | Electric density [C/dm$^2$] | Water washing treatment: First time Method | First time Conductivity [μS/m] | Second time Method | Second time Conductivity [μS/m] | Third time Method | Third time Conductivity [μS/m] |
|---|---|---|---|---|---|---|---|---|---|
| 31 | 0.04 | C | 150 | Immersion | 30 | Immersion | 33 | Immersion | 91 |
| 32 | 0.04 | D | 120 | Spray | 5 | Immersion | 146 | Spray | 77 |
| 33 | 0.04 | A | 70 | Immersion | 10 | Spray | 144 | Immersion | 168 |
| 34 | 0.04 | D | 110 | Immersion | 40 | Immersion | 49 | Spray | 202 |
| 35 | 0.04 | C | 90 | Immersion | 30 | Immersion | 79 | Spray | 38 |
| 36 | 0.04 | F | 80 | Immersion | 22 | Spray | 51 | Immersion | 105 |
| 37 | 0.04 | E | 90 | Immersion | 30 | Immersion | 79 | Spray | 38 |
| 38 | 0.04 | F | 80 | Immersion | 22 | Spray | 51 | Immersion | 105 |
| 39 | 0.04 | B | 60 | Immersion | 84 | Immersion | 69 | Spray | 49 |
| 40 | 0.04 | D | 180 | Spray | 51 | Immersion | 78 | Spray | 11 |
| 41 | 0.04 | E | 250 | Immersion | 93 | Spray | 24 | Spray | 18 |
| 42 | 0.04 | A | 440 | Immersion | 166 | Spray | 6 | Immersion | 45 |
| 43 | 0.04 | C | 250 | Immersion | 93 | Spray | 24 | Spray | 18 |
| 44 | 0.04 | B | 440 | Immersion | 166 | Spray | 6 | Immersion | 45 |
| 45 | 0.04 | D | 130 | Immersion | 32 | Immersion | 17 | Spray | 91 |
| 46 | 0.04 | A | 150 | Immersion | 12 | Immersion | 48 | Spray | 44 |
| 47 | 0.04 | C | 80 | No water washing | — | — | — | — | — |
| 48 | 0.04 | G | 16 | Immersion | 32 | Immersion | 17 | Spray | 12 |
| 49 | 0.04 | G | 48 | Immersion | 32 | Immersion | 17 | Spray | 12 |
| 50 | 0.09 | B | 60 | Spray | 40 | Spray | 12 | — | — |
| 51 | 0.12 | B | 60 | Spray | 40 | Spray | 12 | — | — |

| No. | Production conditions Water washing treatment: Fourth time Method | Fourth time Conductivity [μS/m] | Fifth time Method | Fifth time Conductivity [μS/m] | Remarks |
|---|---|---|---|---|---|
| 31 | — | — | — | — | Example |
| 32 | — | — | — | — | Example |
| 33 | — | — | — | — | Comparative Example |
| 34 | — | — | — | — | Comparative Example |
| 35 | Immersion | 31 | — | — | Example |
| 36 | Spray | 35 | — | — | Example |
| 37 | Immersion | 66 | — | — | Example |
| 38 | Spray | 72 | — | — | Example |
| 39 | Immersion | 188 | — | — | Comparative Example |
| 40 | Spray | 164 | — | — | Comparative Example |
| 41 | Immersion | 16 | Immersion | 42 | Example |
| 42 | Immersion | 9 | Spray | 45 | Example |
| 43 | Immersion | 16 | Immersion | 78 | Example |
| 44 | Immersion | 9 | Spray | 89 | Example |
| 45 | Immersion | 7 | Immersion | 110 | Comparative Example |
| 46 | Immersion | 120 | Spray | 195 | Comparative Example |
| 47 | — | — | — | — | Comparative Example |
| 48 | — | — | — | — | Comparative Example |
| 49 | — | — | — | — | Comparative Example |

TABLE 4-continued

| | | | | | |
|---|---|---|---|---|---|
| 50 | — | — | — | — | Example |
| 51 | — | — | — | — | Example |

TABLE 5

| | Measurement result | | | | | Evaluation | | | | |
|---|---|---|---|---|---|---|---|---|---|---|
| No. | Metallic Cr layer Thickness [nm] | Cr oxide layer Thickness [nm] | Water contact angle [°] | Atomic ratio of adsorbed element *1 [%] | Fe atom ratio *2 [%] | Film corrosion resistance | Coating corrosion resistance | Film wet adhesion | Coating secondary adhesion | Remarks |
| 31 | 11.2 | 3.8 | 36.5 | 4.8 | 0.0 | Δ | Δ | Δ | Δ | Example |
| 32 | 9.3 | 2.9 | 15.3 | 4.4 | 0.0 | Δ | Δ | Δ | Δ | Example |
| 33 | 5.6 | 1.2 | 42.1 | 7.4 | 3.4 | X | X | X | X | Comparative Example |
| 34 | 8.4 | 1.5 | 17.3 | 8.3 | 0.0 | X | X | X | X | Comparative Example |
| 35 | 7.2 | 1.6 | 44.1 | 2.2 | 0.6 | ○ | ○ | ○ | ○ | Example |
| 36 | 6.3 | 2.8 | 13.3 | 1.1 | 2.6 | ○ | ○ | ○ | ○ | Example |
| 37 | 7.2 | 1.6 | 41.0 | 3.2 | 0.3 | Δ | Δ | Δ | Δ | Example |
| 38 | 6.3 | 2.8 | 13.2 | 3.9 | 5.3 | Δ | Δ | Δ | Δ | Example |
| 39 | 5.1 | 2.6 | 11.5 | 5.6 | 6.6 | X | X | X | X | Comparative Example |
| 40 | 13.5 | 3.5 | 10.3 | 6.3 | 0.0 | X | X | X | X | Comparative Example |
| 41 | 19.3 | 3.7 | 22.3 | 2.7 | 0.0 | ○ | ○ | ○ | ○ | Example |
| 42 | 33.5 | 3.9 | 12.1 | 2.8 | 0.0 | ○ | ○ | ○ | ○ | Example |
| 43 | 19.3 | 3.7 | 22.5 | 4.3 | 0.0 | Δ | Δ | Δ | Δ | Example |
| 44 | 33.5 | 3.9 | 12.3 | 4.5 | 0.0 | Δ | Δ | Δ | Δ | Example |
| 45 | 9.9 | 1.6 | 13.5 | 7.9 | 0.0 | X | X | X | X | Comparative Example |
| 46 | 11.3 | 2.9 | 14.4 | 9.1 | 0.0 | X | X | X | X | Comparative Example |
| 47 | 6.6 | 1.3 | 67.8 | 5.8 | 0.8 | X | X | X | X | Comparative Example |
| 48 | — | — | 72.3 | 2.4 | 0.0 | X | X | ○ | ○ | Comparative Example |
| 49 | — | — | 62.6 | 1.1 | 0.0 | X | X | ○ | ○ | Comparative Example |
| 50 | 5.0 | 2.6 | 28.3 | 0.0 | 12.3 | ○ | ○ | ○ | ○ | Example |
| 51 | 5.2 | 2.0 | 34.2 | 0.0 | 16.2 | Δ | Δ | Δ | Δ | Example |

*1 Total atomic ratio of K, Na, Mg, and Ca adsorbed on the surface to Cr
*2 Atomic ratio of Fe on the surface to Cr

The invention claimed is:

1. A surface-treated steel sheet having: a steel sheet; a metallic Cr layer disposed on at least one surface of the steel sheet; and a Cr oxide layer disposed on the metallic Cr layer, the surface-treated steel sheet having:

a water contact angle of 50° or less; and a total atomic ratio of K, Na, Mg, and Ca adsorbed on the surface to Cr of 5% or less.

2. The surface-treated steel sheet according to claim 1, wherein the metallic Cr layer has a thickness of 3 nm to 100 nm.

3. The surface-treated steel sheet according to claim 1, wherein the Cr oxide layer has a thickness of 0.5 nm to 15 nm.

4. The surface-treated steel sheet according to claim 1, having an atomic ratio of Fe on the surface of the surface-treated steel sheet to Cr of 15% or less.

5. A method of producing a surface-treated steel sheet having: a steel sheet; a metallic Cr layer disposed on at least one surface of the steel sheet; and a Cr oxide layer disposed on the metallic Cr layer, the method comprising:

an electrolyte preparation process to prepare an electrolyte containing trivalent chromium ions;

a cathodic electrolysis treatment process to subject a steel sheet to cathodic electrolysis treatment in the electrolyte;

a water washing process to subject the steel sheet after the cathodic electrolysis treatment to water washing at least once; and thereby producing the surface-treated steel sheet having:

a water contact angle of 50° or less; and a total atomic ratio of K, Na, Mg, and Ca adsorbed on the surface to Cr of 5% or less, wherein, in the electrolyte preparation process, the electrolyte is prepared by:

mixing a trivalent chromium ion source, a carboxylic acid compound, and water; and adjusting the pH to 4.0 to 7.0 and the temperature to 40° C. to 70° C., and in the water washing process, at least the last water washing uses water with an electrical conductivity of 100 μS/m or less.

6. The surface-treated steel sheet according to claim 2, wherein the Cr oxide layer has a thickness of 0.5 nm to 15 nm.

7. The surface-treated steel sheet according to claim 2, having an atomic ratio of Fe on the surface of the surface-treated steel sheet to Cr of 15% or less.

8. The surface-treated steel sheet according to claim 3, having an atomic ratio of Fe on the surface of the surface-treated steel sheet to Cr of 15% or less.

9. The surface-treated steel sheet according to claim 6, having an atomic ratio of Fe on the surface of the surface-treated steel sheet to Cr of 15% or less.

* * * * *